US005462328A

United States Patent [19]

Chandler et al.

[11] Patent Number: 5,462,328

[45] Date of Patent: Oct. 31, 1995

[54] BALL CARRIER APPARATUS

[76] Inventors: Ricky D. Chandler; Dixie N. Chandler, both of Rte. 3, Box 123-H, Farmersville, Tex. 75442

[21] Appl. No.: 204,805

[22] Filed: Mar. 2, 1994

[51] Int. Cl.[6] ..... A63B 47/00; B65D 71/00

[52] U.S. Cl. ..... 294/143; 294/146; 294/169; 224/919

[58] Field of Search ..... 294/19.2, 141–143, 294/146, 159, 162, 163, 167, 169; 16/114 R, 126; 206/315.1, 315.9; 224/151, 235, 241, 251, 919

[56] References Cited

U.S. PATENT DOCUMENTS

| | | | |
|---|---|---|---|
| 1,648,565 | 11/1927 | Primley | 224/919 X |
| 4,046,284 | 9/1977 | Samuelsson | 294/19.2 X |
| 4,088,251 | 5/1978 | Rodriguez | 294/146 X |
| 4,193,495 | 3/1980 | Keeley | 294/143 |
| 4,522,438 | 6/1985 | Logue | 294/19.2 |
| 4,595,226 | 6/1986 | Wessel | 294/143 X |
| 4,629,065 | 12/1986 | Braaten | 206/315.9 X |
| 4,890,731 | 1/1990 | Mroz | 294/143 X |

*Primary Examiner*—Johnny D. Cherry
*Attorney, Agent, or Firm*—John E. Vandigriff

[57] ABSTRACT

The invention is to a utility carrier for carrying balls, and for dispensing balls and holding balls during a ball game, and for storage of balls and bats, and other equipment between games. The carrier is attached to a fence or other object. Balls are held in the carrier, and a rigid handle attached to and suspended below the carrier has clips thereon for holding bats.

17 Claims, 4 Drawing Sheets

BALL CARRIER APPARATUS

FIELD OF THE INVENTION

This invention relates generally to a ball carrier, and specifically to a ball carrier apparatus for transporting ball used in sports games and includes means for mounting the ball carrier and holding bats.

BACKGROUND OF THE INVENTION

Ball carriers for securing to the ball player have been known. These carriers for golf balls and tennis balls are usually secured to the belt, or carried on the back or shoulders with a strap.

U.S. Pat. Nos. 4,522,438 and 4,629,235 describe a retriever and dispenser for tennis balls. The balls are held in a tubular body in which the balls are held with a light friction so that the balls will not fall out when the tubular structure is being used as a ball retriever. The dispenser may be carried over the shoulder with a strap, or attached to a fence with a hook on one end of the carrier.

A belt supported golf ball carrier is described in U.S. Pat. No. 1,610,344. The player may remove balls while playing, and have ready access to a ball.

Other known prior art which may be pertinent to the following invention are:

| | | |
|---|---|---|
| 1,648,565 | Primley | November 8, 1927 |
| 4,088,251 | Rodrigues | May 9, 1978 |
| 4,629,065 | Braaten | December 16, 1986 |

SUMMARY OF THE INVENTION

This invention is to a combination apparatus that serves as container for storing, transporting and dispensing balls. The structure of the apparatus is such that it can be mounted on a fence or other structure while holding and dispensing balls. A combination handle and bat holder is detachably secured to the ball holder. Clips are recessed in the handle to hold bats. The handle can be used in transporting the ball container, or removed and the ball container carried by a detachable strap. The container has internal ridges that extend inwardly in the container to form a track on which the balls are carried. In this manner the balls are not in contact with the entire inner circumference of the carrier and may be easily inserted or removed from the container.

The technical advance represented by the invention, as well as the objects thereof, will become apparent from the following description of a preferred embodiment of the invention when considered in conjunction with the accompanying drawings, and the novel features set forth in the appended claims.

DESCRIPTION OF A PREFERRED EMBODIMENT

Figure 1:
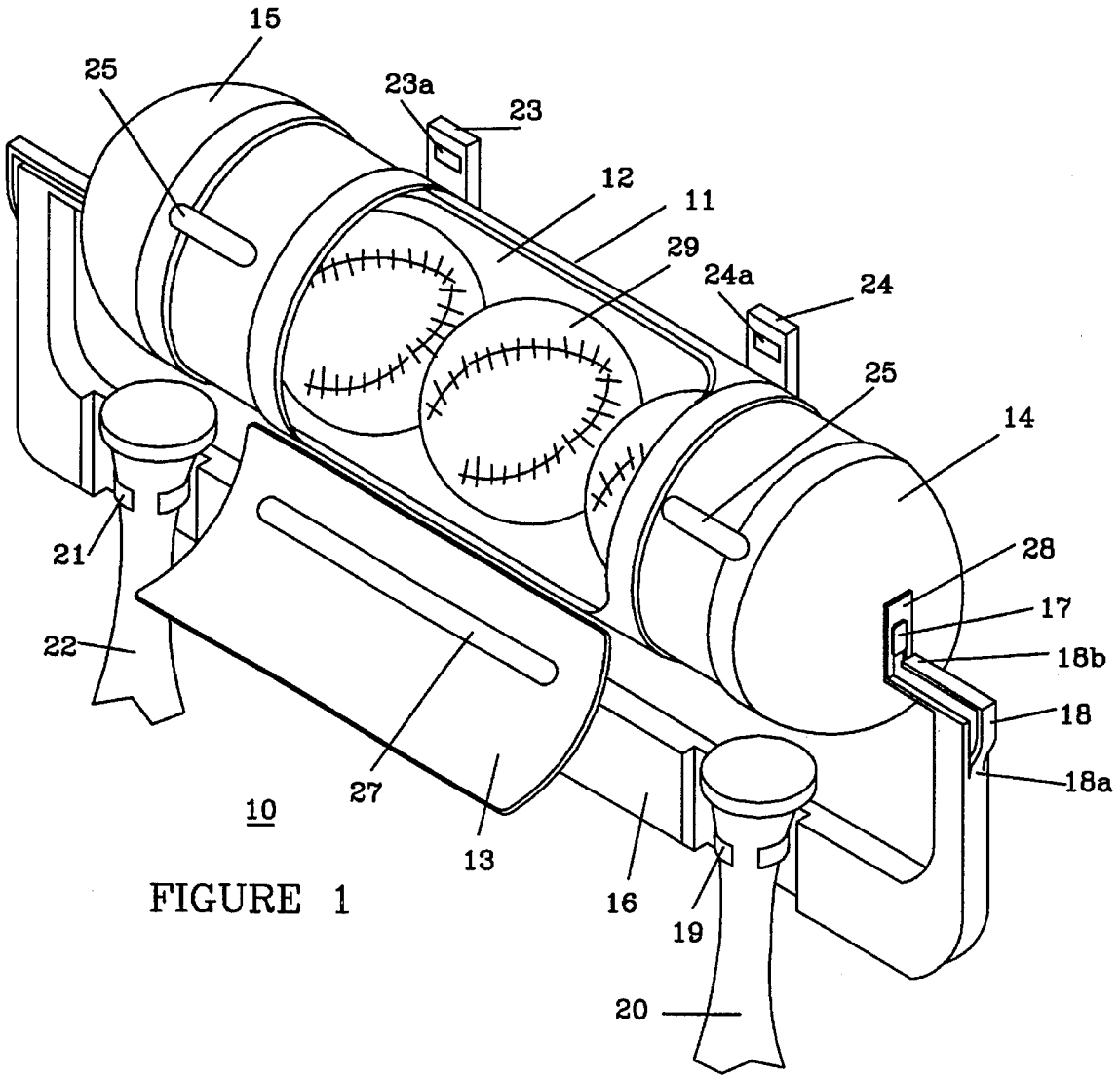
FIG. 1 is a isometric view of the ball carrier apparatus of the present invention.

FIG. 1 shows a ball carrier apparatus for transporting balls, and for holding balls 29 and bats 20 and 22, or ball rackets, or other accessories, depending upon the game being played. Apparatus 10 includes a carrier 11 that is tubular in shape, and is molded as one piece. Carrier 11 has a door 13 that, when opened, provides access to balls in the carrier. The ends 14 and 15 of carrier 11 are rounded to receive balls.

On each end, 14 and 15, is a stud 17 (only one shown in FIG. 1) used to connect detachable handle 16 to the round ends 14 and 15. Each end of handle 16 has a slotted member 28 that is placed on stud 17 and held in place by lock 18. To remove handle 16 from carrier 11, lock 18 is pulled away from stud 17 and the handle is lifted to remove stud 17 from slotted member 28.

When handle 16 is locked in place, end 18b of lock 18 is under stud 17, preventing it from moving out of slotted member 28, and from rotating about stud 17. Lock 18 is an integral part of handle 16 and is jointed to handle 16 at flexible connection 18*a*.

Figure 3:
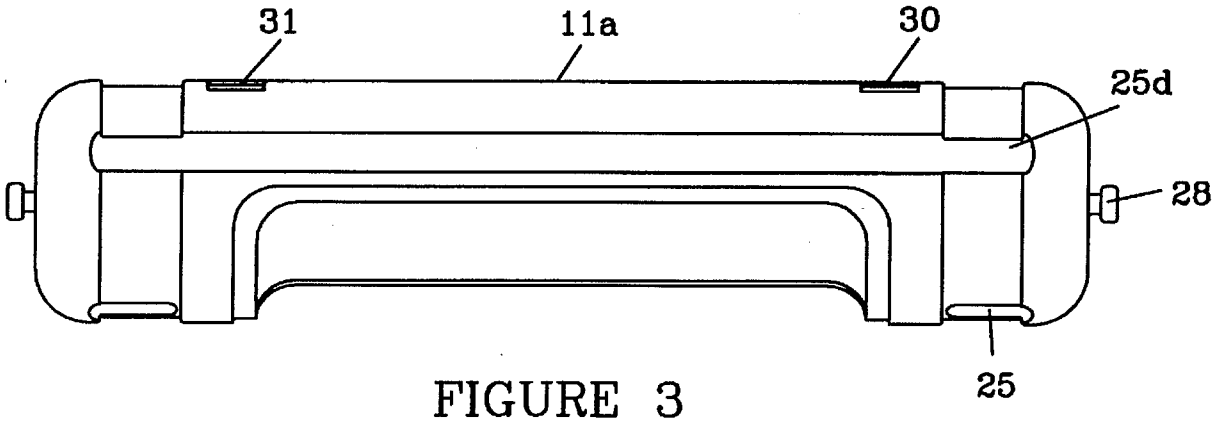
FIG. 3 is a top view of the ball carrier.

Attached to carrier 11 are two clips 23 and 24. Clips 23 and 24 are removably snapped into slots 30 and 31 (FIG. 3). Each clip has a slot opening 23*a*, 24*a* through which strap or hooks (not illustrated) may be placed. A strap may be used as a carrying strap or for securing the carrier to, for example, the ball back stop at a ball playing field. Two separate hooks may also be used to mount carrier 11 to a fence or back stop.

When carrier 11 is mounted, or suspended from a fence or other structure, door 13 may be opened to hold balls, or to retrieve a ball. Also, when mounted, handle 16 may be attached to carrier 11, and ball bats 20 and 22 may be attached to clips 19 and 21. When not in use, or being transported, carrier 11 may be carried by a strap attached to clips 23 and 24, or carried by handle 16. Handle 16 need not be removed when carrier is being transported by a strap connected to clips 23 and 24.

Carrier 11 has ridges 25, 27 and other ridges, as explained below, that extend into the interior of carrier 11.

Figure 2:
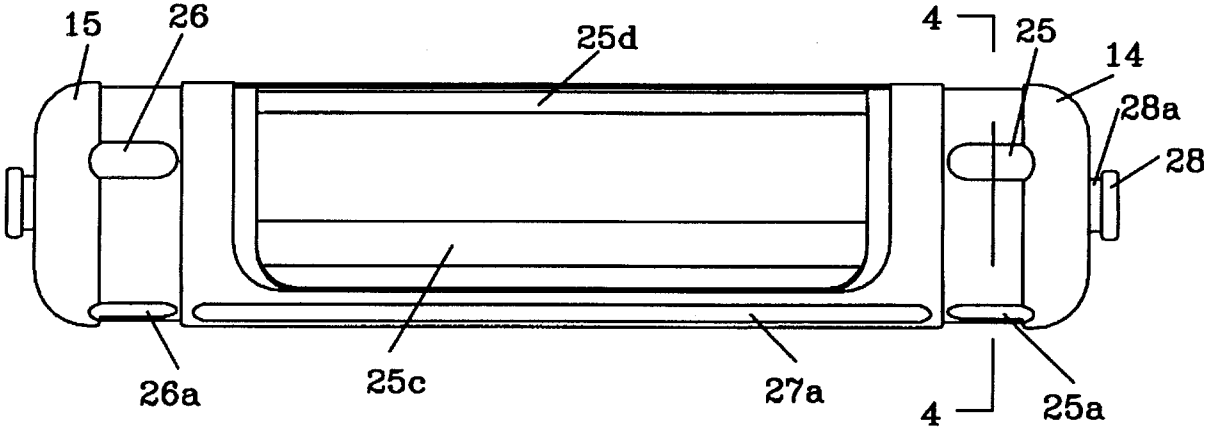
FIG. 2 is a front view of the ball carrier.

FIGS. 2 and 3 are front and top views, respectively, of carrier 11, with door 13 removed. Shown are grooves 25, 25*a*, 25*c*, 25*d*, 26 and 26*a*. The groves are concave on the outside of carrier 11 and are convex internal to carrier 11.

Figure 4:
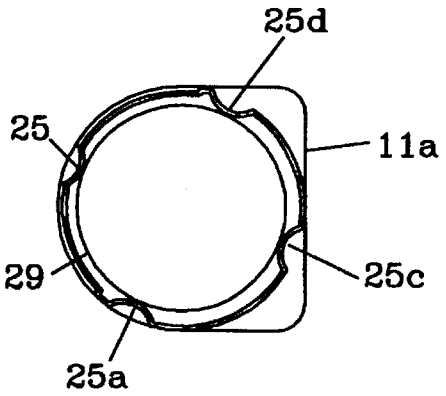
FIG. 4 is an end view of the ball carrier.

FIG. 4 is a cross-sectional view of carrier 11, taken through section 5—5. Grooves 25, 25*a*, 25*c* and 25*d* are shown extending inside of carrier 11. The grooves are used to hold a balls in the interior of carrier 11 such that the balls contact the interior only along the grooves. This minimal contact of the balls with the interior of the carrier permits ease of removal of the balls. If a ball had contact around its circumference with the internal circumference of carrier 11, a vacuum might prevent easy removal of a ball, permitting a ball to become trapped in one of the round ends 14 or 15. A ball 29 is shown in FIG. 4, mounted in the grooves.

Figure 5:
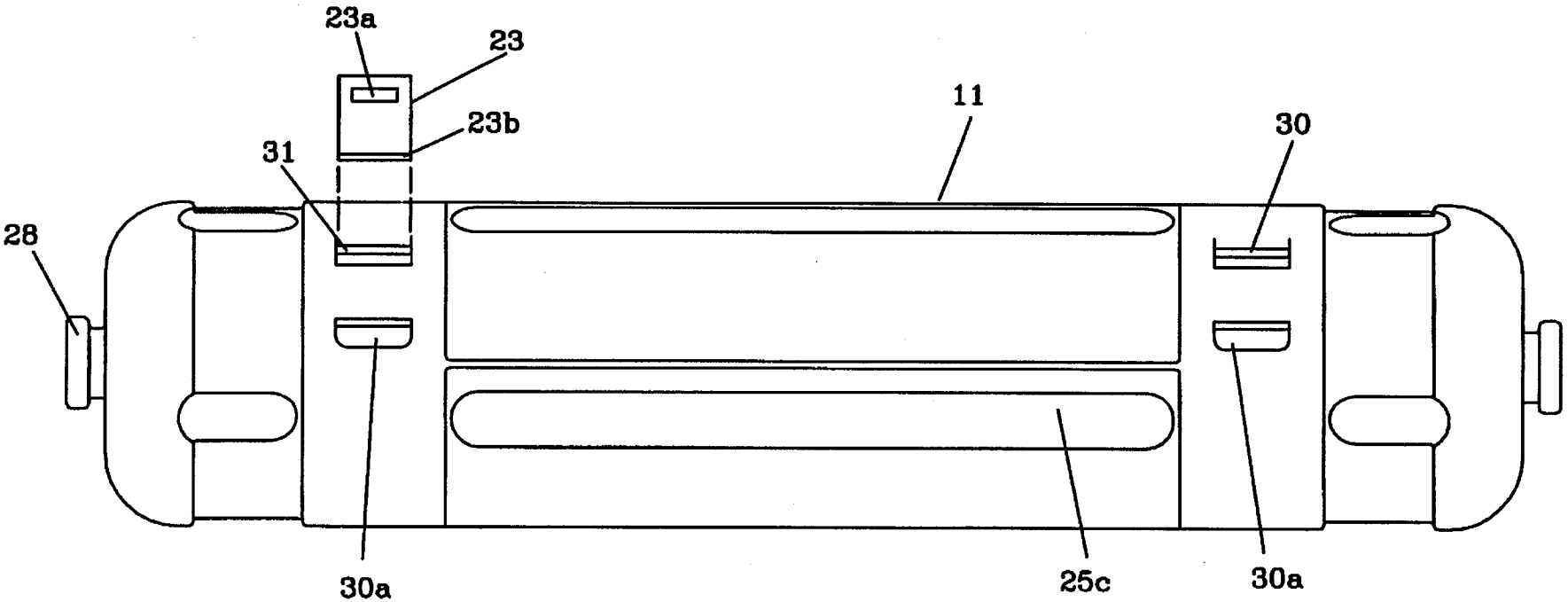
FIG. 5 is a back view of the ball carrier.

FIG. 5 is a back view of carrier 11 showing slots 31 into which clips 23 and 24 are mounted. Clip 23 is inserted into slot 31 with ridge 23*b* locking clip 23 into slot opening 31. To removed clip 23, ridge 23*b* is pressed inward while pulling upward on clip 23.

Figure 8:
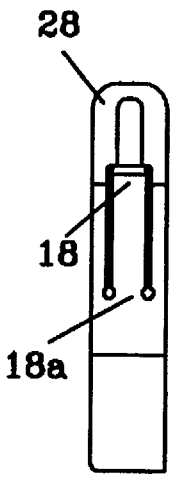
FIG. 8 is an end view of the handle and bat rack.
Figure 7:
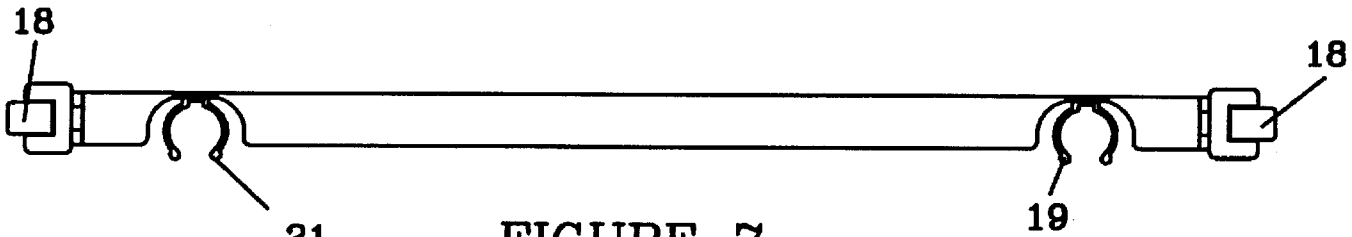
FIG. 7 is a top view of the handle and bat rack.
Figure 6:
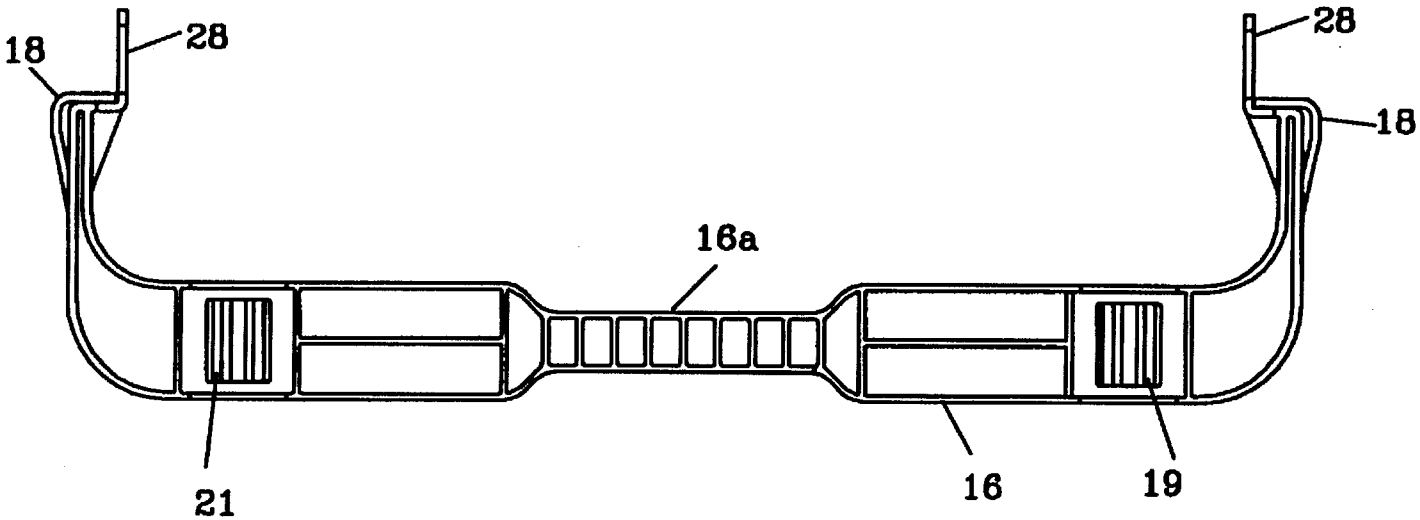
FIG. 6 is a front view of the handle and bat rack.

FIGS. 6, 7 and 8 are front, top and end views of removable handle 16. Handle 16 has a central reduced portion 16*a* which is used for grasping handle 16 while it is attached to carrier 11.

Locks 18 are pulled outward, flexing at 18*a*, to permit attaching and detaching of handle 16 from carrier 11. Clips 19 and 21 are used to hold ball bats, as illustrated in FIG. 1, when carrier 11 and handle 16 are attached to each other and mounted on a fence or wall.

Carrier 11 can be molded as a single entity, with the exception of door 13. Similarly, handle 16 can be molded as a single entity. Material such as high impact plastic, fiber composite material, and fiber glass are suitable materials. Handle 16 is constructed of a ridged material similar to carrier 11 to provide support for bats mounted in clips 19 and 21. Since handle 16 can be detached from carrier 11, carrier 11 may be used for the sole purpose of carrying balls, utilizing a strap attached to clips 23 and 24. When handle 16 is attached, handle 16 can be used to carry carrier 11. Handle 16 may remain attached when carrier 11 is carried by a strap.

What is claimed:

1. A sports utility carrier for holding balls and equipment, comprising:

a cylindrical housing, having exterior and interior walls, and an opening in one side providing access to the interior of said housing;

a hinged cover for closing said opening;

a generally U-shaped handle having a main handle bar and two attachment arms on each end of the main handle bar;

a pair of studs, one each on opposite ends of said housing for removably securing said handle to said housing; and a plurality of ridges extending the length of and internal to said housing for holding balls inside said housing spaced from the interior walls of said housing.

2. The carrier according to claim 1, wherein said handle has at least two clips thereon for holding ball bats.

3. The carrier according to claim 1, wherein said housing has two slots in the exterior wall for securing clips to which a carrying strap may be attached, and for suspending said carrier from a mounting surface.

4. The carrier according to claim 1, wherein said handle includes a lock lever on an end of each attachment arm for securing each attachment arm to one of said studs.

5. The carrier according to claim 1, wherein said plurality of ridges are an integral part of the housing and form concave portions on the exterior wall of the carrier, and form convex ridges on the interior wall of said housing.

6. The carrier according to claim 1, wherein the opening in the side of the housing is centrally located between opposite ends of said housing.

7. A sports utility carrier for holding balls and equipment, comprising:

a cylindrical housing, having exterior and interior walls, and an opening in one side providing access to the interior of said housing;

a hinged cover for closing said opening;

a generally U-shaped handle having a main handle bar and two attachment arms on each end of the main handle bar;

a pair of studs, one each on opposite ends of said housing for removably securing said handle to said housing;

a plurality of ridges extending the length of and internal to said housing for holding balls inside said housing spaced from the interior walls of said housing; and a pair of clips secured to said housing to which a carrying strap is secured.

8. The carrier according to claim 7, wherein said handle has at least two clips thereon for holding ball bats.

9. The carrier according to claim 7, wherein said housing has two slots in the exterior wall for securing said pair of clips to which a carrying strap may be attached.

10. The carrier according to claim 7, wherein said handle includes a lock lever on an end of each attachment arm for securing each attachment arm to one of said studs.

11. The carrier according to claim 7, wherein said plurality of ridges are an integral part of the housing and form concave portions on the exterior wall of the carrier, and form convex ridges on the interior wall of said housing.

12. The carrier according to claim 7, wherein the opening in the side of the housing is centrally located between opposites ends of said housing.

13. A sports utility carrier for holding balls and equipment, comprising:

a cylindrical housing, having exterior and interior walls, and an opening in one side providing access to the interior of said housing;

a hinged cover for closing said opening;

a generally U-shaped handle having a main handle bar and two attachment arms on each end of the main handle bar;

a pair of mounting clips on said handle for holding bats;

a pair of studs, one each on opposite ends of said housing for removably securing said handle to said housing;

a plurality of ridges extending the length of and internal to said housing for holding balls inside said housing spaced from the interior walls of said housing; and a pair of clips secured to said housing to which a carrying strap is secured.

14. The carrier according to claim 13, wherein said housing has two slots in the exterior wall for securing said pair of clips to which a carrying strap may be attached.

15. The carrier according to claim 13, wherein said handle includes a lock lever on an end of each attachment arm for securing each attachment arm to one of said studs.

16. The carrier according to claim 13, wherein said plurality of ridges are an integral part of the housing and form concave portions on the exterior wall of the carrier, and form convex ridges on the interior wall of said housing.

17. The carrier according to claim 13, wherein the opening in the side of the housing is centrally located between opposite ends of said housing.

* * * * *